US006077372A

United States Patent [19]

Mendenhall et al.

[11] Patent Number: 6,077,372

[45] Date of Patent: Jun. 20, 2000

[54] IGNITION ENHANCED GAS GENERANT AND METHOD

[75] Inventors: Ivan V. Mendenhall, Providence; Robert D. Taylor, Hyrum; David W. Parkinson, N. Ogden; Gregory B. Hess, Hyrum, all of Utah

[73] Assignee: Autoliv Development AB, Vargarda, Sweden

[21] Appl. No.: 09/243,161

[22] Filed: Feb. 2, 1999

[51] Int. Cl.[7] ..... D03D 23/00; C06B 31/28; C06B 45/34

[52] U.S. Cl. ..... 149/109.6; 149/7; 149/46

[58] Field of Search ..... 149/6, 7, 8, 9, 149/11, 14, 15, 19.92, 109.6, 46

[56] References Cited

U.S. PATENT DOCUMENTS

| | | | |
|---|---|---|---|
| 3,794,535 | 2/1974 | Bertrand et al. | 149/3 |
| 3,855,022 | 12/1974 | Flynn | 149/8 |
| 3,956,038 | 5/1976 | Duguet et al. | 149/4 |
| 4,092,187 | 5/1978 | Hildebrant et al. | 149/11 |
| 4,179,327 | 12/1979 | Seldner | 156/667 |
| 4,244,758 | 1/1981 | Garner et al. | 149/7 |
| 4,246,051 | 1/1981 | Garner et al. | 149/7 |
| 4,390,380 | 6/1983 | Camp | 149/8 |
| 4,696,705 | 9/1987 | Hamilton | 149/21 |
| 4,698,107 | 10/1987 | Goetz et al. | 149/7 |
| 4,770,728 | 9/1988 | Berg et al. | 149/11 |
| 4,798,142 | 1/1989 | Canterberry et al. | 102/290 |
| 4,806,180 | 2/1989 | Goetz et al. | 149/3 |
| 5,000,885 | 3/1991 | Laird et al. | 264/3.1 |
| 5,034,070 | 7/1991 | Goetz et al. | 149/3 |
| 5,051,143 | 9/1991 | Goetz | 149/3 |
| 5,273,313 | 12/1993 | Klober et al. | 280/741 |
| 5,322,018 | 6/1994 | Hadden et al. | 102/284 |
| 5,345,873 | 9/1994 | Lauritzen et al. | 102/290 |
| 5,495,807 | 3/1996 | Klober et al. | 102/289 |
| 5,507,890 | 4/1996 | Swann et al. | 149/16 |
| 5,541,009 | 7/1996 | Hieke et al. | 427/213 |
| 5,551,343 | 9/1996 | Hock et al. | 102/288 |
| 5,670,740 | 9/1997 | Barnes et al. | 149/62 |
| 5,672,843 | 9/1997 | Evans et al. | 102/289 |
| 5,682,013 | 10/1997 | Smith et al. | 149/6 |
| 5,731,540 | 3/1998 | Flanigan et al. | 149/109.6 |
| 5,739,460 | 4/1998 | Knowlton et al. | 102/324 |

*Primary Examiner*—Charles T. Jordan
*Assistant Examiner*—Aileen J. Baker
*Attorney, Agent, or Firm*—Pauley Peterson Kinne & Fejer

[57] ABSTRACT

An ignition enhanced gas generant material and method of making the same utilizing a solvent effective to partially solubilize at least one component of each of a selected ignition composition and, upon application to the gas generant material, at least one component of an associated gas generant material.

30 Claims, 4 Drawing Sheets

IGNITION ENHANCED GAS GENERANT AND METHOD

BACKGROUND OF THE INVENTION

This invention relates generally to gas generating materials such as used in the inflation of inflatable devices such as inflatable vehicle occupant restraint airbag cushions and, more particularly, to ignition enhanced gas generating materials.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Upon actuation of the system, the cushion begins to be inflated, in a matter of no more than a few milliseconds, with gas produced or supplied by a device commonly referred to as an "inflator."

Many types of inflator devices have been disclosed in the art for use in the inflating of one or more inflatable restraint system airbag cushions. Many prior art inflator devices include solid form gas generant materials which are burned to produce or form gas used in the inflation of an associated airbag cushion.

Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials meets current industry specifications, guidelines and standards, such use may involve or raise potential concerns such as involving the safe and effective handling, supply and disposal of such gas generant materials.

Further, such inflator devices tend to involve rather complex ignition processes. For example, it is relatively common to employ an electrically initiated squib to ignite a separate charge of an igniter composition. The products of such ignition are then used to ignite a gas generant material, also contained within the inflator device. In practice, the ignition process of many various prior inflator devices require a separate igniter charge because the squib does not itself generally supply sufficient hot gas, condensed phase particles or other ignition products to sufficiently heat the gas generant material to result in the reaction of the material and desired gas generation.

As is known, the inflator incorporation of an ignition cord is a common means of obtaining substantially simultaneous ignition of an extended length of a charge of an igniter composition. In practice, it is common that such length of ignition cord be housed or contained within an igniter tube extending within the igniter charge. While ignition of the gas generant material may ultimately be achieved through the use of such an igniter charge, such an ignition process may be undesirably complicated and may tend to undesirably complicate the manufacture, production and design of the associated inflator device as well. For example, such use necessitates that an igniter composition be manufactured or made and then subsequently handled such as through manufacture of a desired form of container to hold or store the igniter composition for subsequent incorporation into the inflator device design as a part of an igniter assembly.

In addition, the use of such an ignition process can detrimentally impact either or both the weight and cost of the corresponding apparatus hardware. For example, the incorporation and use of such an igniter tube and ignition cord will typically increase both the weight and cost associated with a corresponding assembly.

As will be appreciated, space is often at a premium in modem vehicle designs. Consequently, it is generally desired that the space requirements for various vehicular components, including inflatable vehicle occupant restraint systems, be reduced or minimized to as great an extent as possible. The incorporation of an igniter assembly such as described above and associated support structure(s), may require a larger than desired volume of space within an associated inflator device. In particular, such volume of space could alternatively potentially be utilized to store or contain gas generant material and thereby permit the volume of space required by the inflator device to be reduced.

Thus, there is a need and a demand for alternative airbag inflator device ignition schemes and, in particular, there is a need and a demand for avoiding the requirement or inclusion of separate igniter composition charges and associated hardware. Various patents, including U.S. Pat. Nos. 4,698,107; 4,806,180; and 5,034,070, disclose processing wherein an ignition coating is applied, such as in the form of a liquid or a water slurry, to azide-based gas generant materials. Such processing typically necessitates first the formation of the azide-based gas generant, including the proper forming and drying of gas generant grains in selected shapes, followed by the coating of the grain with a wet slurry of the ignition material, such as by immersion of the grain in a slurry of the coating material, and then final drying.

In such dip coat processing, generally either individual gas generant tablets or wafers are coated as they go through a coating slurry on a conveyer belt, or the gas generant tablets or wafers are put in bulk containers and submerged in the slurried coating material. These types of process are typically relatively slow and may lead to problems such as coated tablets/wafers sticking either or both to themselves and associated equipment, such as conveyer belts.

In addition, dependent on the shape of the gas generant tablet or wafer there may also be a problem in obtaining application of a uniform coating. For example, if the gas generant material has a relatively flat form, the slurry coating may tend to pool and may therefore dry to form a coating of variable thicknesses.

Also, dip coating equipment (e.g., dip baskets and conveyer belts) may easily be contaminated with igniter material, leading to potential or increased safety concerns.

In view of the above, there is a need and a demand for materials and processing techniques such as avoid the requirement or inclusion of a separate igniter composition charge and which desirably simplify and/or facilitate manufacture, production or use.

Testing has shown that in the formation of ignition enhanced forms of at least certain gas generant materials, only a relatively narrow range of moisture content may be permitted. For example, an insufficient gas generant moisture level or content may result in an ignition composition failing to desirably adhere or join with the gas generant material. Correspondingly, an excessive or too great a moisture level or content may result in the formation of an ignition inhibiting surface or coating on the gas generant material rather than a desired ignition enhancing surface. In particular, those gas generant compositions which lack an effective binder component appear to have a particularly limited or narrow range of allowable moisture content for obtaining or resulting in an ignition enhanced gas generant having a coating or other suitable ignition enhancing material surface.

Thus, there is a need and demand for alternatives to azide-based pyrotechnics and related gas generants as well as for alternative improved ignition enhanced gas generating materials such as used in the inflation of inflatable devices such as an inflatable vehicle occupant restraint airbag cushions and related methods of processing such as may permit or facilitate the placement of an ignition composition onto a gas generant material having a selected form. In particular, there is a need and a demand for ignition enhanced gas generating materials and related processing methods wherein the gas generant material itself has a relatively low moisture content or level and/or lacks an effective binder component and such as may further desirably avoid the requirement or inclusion of a separate or distinct igniter composition charge.

SUMMARY OF THE INVENTION

A general object of the invention is to provide an improved gas generating material such as used in the inflation of inflatable devices such as an inflatable vehicle occupant restraint airbag cushions and related method of processing.

A more specific objective of the invention is to overcome one or more of the problems described above.

The general object of the invention can be attained, at least in part, through a specified method of placing an ignition composition onto a gas generant material having a selected form. In accordance with one preferred embodiment of the invention, such method includes the steps of combining the ignition composition with a solvent to form an ignition material combination and then applying the ignition material combination onto the gas generant material form. The solvent is effective to partially solubilize at least one component of the ignition composition and, upon application to the gas generant material, at least one component of the gas generant material.

The prior art generally fails to provide an as simple as may be desired processing technique whereby the need or requirement for inclusion of a separate igniter composition charge to effect desired ignition of a quantity or mass of associated gas generant material can be avoided. More particularly, the prior art generally fails to provide an as simple and as effective as may be desired processing technique such as permits the placement of an ignition composition onto a selected form of gas generant material. For example, the prior art generally fails to provide an effective technique permitting the spray application of an ignition composition onto a gas generant material or a corresponding body of material such as which is ignitable to generate a gas for inflating an airbag.

The invention further comprehends a method of applying an ignition composition to gas generant material comprising ammonium nitrate, wherein the gas generant material has a form selected from the group consisting of a grain, tablet and wafer. In accordance with one preferred embodiment, such method includes the steps of suspending the ignition composition in a hydrocarbon-containing solvent effective to partially solubilize at least one component of the ignition composition, followed by spraying the solvent-suspended ignition composition onto the gas generant material form, with the solvent effective to partially solubilize the ammonium nitrate of the gas generant material.

The invention still further comprehends a body of material which is ignitable to generate a gas for inflating an airbag. In particular, such body of material includes a gas generant material having a selectively applied spray coating of an ignition composition.

Other objects and advantages will be apparent to those skilled in the art from the following detailed description taken in conjunction with the appended claims and drawings.

DETAILED DESCRIPTION OF THE INVENTION

Figure 1:
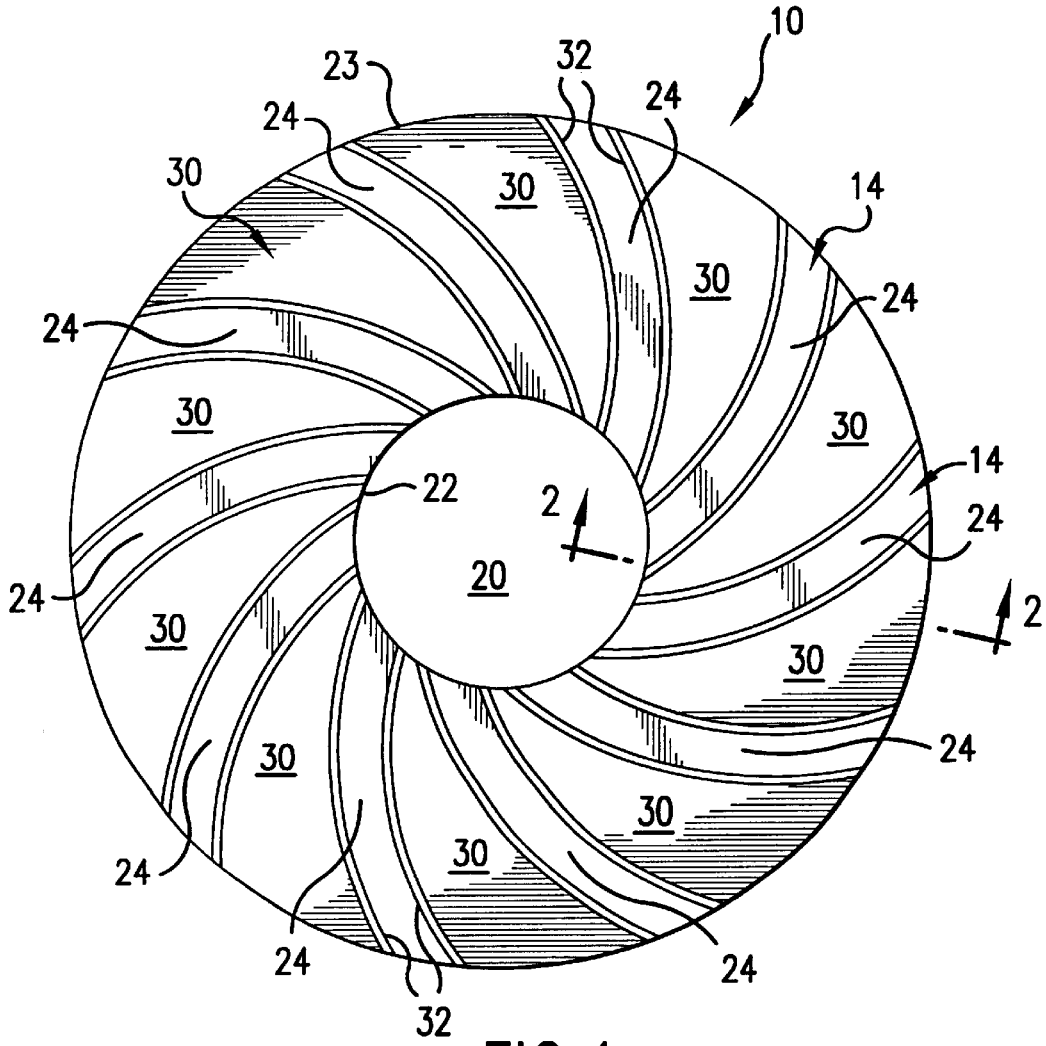
FIG. 1 is a top plan view of a washer-shaped gas generant wafer such as may be used in the practice of the invention.

The present invention provides an ignition enhanced gas generant as well as related or corresponding processing methods. The invention contemplates an ignition enhanced gas generant wherein an ignition material combination formed by an ignition composition and a solvent is applied onto a gas generant material having a selected form. The solvent is selected to be effective to partially solubilize at least one component of each ofthe ignition composition and, upon application thereto, the gas generant material.

The invention is generally useable with any effective combination of ignition composition, gas generant material and solvent. As will be appreciated, typical igniter or ignition compositions and gas generants useful in the practice of the invention include a combination of fuel and oxidizer components.

The igniter composition utilized in the practice of a preferred embodiment of the invention is desirably formulated as a combination of fuel and oxidizer components. Useful igniter composition fuels include metal-containing or metal-based materials such as aluminum, boron, magnesium, silicon, titanium, zirconium, alloys of aluminum and magnesium, titanium hydride, zirconium hydride and combinations thereof. Particularly useful igniter composition fuels include boron, aluminum, alloys of aluminum and magnesium and combinations thereof.

Useful igniter composition oxidizers include alkali metal nitrates, chlorates and perchlorates; alkaline earth metal nitrates, chlorates and perchlorates; ammonium nitrate; ammonium perchlorate; basic copper nitrate and combinations thereof. In practice, preferred igniter compositions for use in the practice of the invention contain between about 10 to about 40 wt % of such fuels and between about 60 to about 90 wt % of such oxidizers.

As will be appreciated, a variety of materials can, as may be desired, be used as a fuel component in the associated gas generant composition. For reasons such as identified above, fuel materials for use in the practice of at least certain preferred embodiments of the invention are non-azide in nature. Groups or categories of fuels useful in the practice of the invention include various nitrogen-containing organic fuel materials and tetrazole complexes of at least one transition metal. Specific examples of nitrogen-containing organic fuel materials useful in the practice of the invention include guanidine nitrate, aminoguanidine nitrate, triaminoguanidine nitrate, nitroguanidine, dicyandiamide, triazalone, nitrotriazalone, tetrazoles and mixtures thereof. Tetrazole complexes of transition metals such as copper, cobalt, and possibly zinc, for example, can be used. Also, the gas generating fuel component of particular gas generant compositions may, if desired, be comprised of individual such fuel materials or combinations thereof. In accordance with certain preferred embodiments of the invention, between about 30 and about 60 wt % of the gas generant material constitutes such a gas generating fuel component.

In addition, the fuel component of the subject gas generating material may, if desired, include a metallic fuel material. Specific examples of metallic fuels useful in the practice of the invention include silicon, aluminum, boron, magnesium, alloys of aluminum and magnesium and combinations thereof.

The fuel component of the subject gas generating material, in accordance with certain particularly preferred embodiments of the invention, includes the fuel materials guanidine nitrate or guanidine nitrate in combination with one or more metallic fuels. In practice, guanidine nitrate is a particularly preferred fuel due to one or more various factors including: having a relatively low commercial cost; generally avoiding undesired complexing with copper or other transition metals which may also be present; is itself relatively highly oxygenated and thus may serve to minimize or reduce the amount of externally provided oxidant required for combustion.

While the inclusion of metallic fuels such as silicon, aluminum, boron, alloys of aluminum and magnesium alloys and combinations thereof can serve various purposes, in general such metallic fuels may desirably be included in such compositions to increase the combustion temperature of the resulting composition. As will be appreciated, such metallic fuels, when included, may desirably be utilized in a powder form such as to facilitate mixing and combination with other composition components. When included, the powders of silicon, aluminum, boron, alloys of aluminum and magnesium alloys and combinations thereof may generally desirably be present in an amount of up to about 5 wt % of the total gas generant component.

A variety of materials can, as may be desired, be used as an oxidizer component in such associated gas generant compositions. In accordance with certain preferred embodiments of the invention, between about 15 and about 55 wt % of the gas generant material constitutes a metal ammine nitrate oxidizer. Preferred metal ammine nitrate oxidizer materials for use in the practice of the invention include copper diammine dinitrate, zinc diammine dinitrate and combinations thereof.

The gas generant materials may, if desired, additionally contain up to about 35 wt % of an ammonium nitrate supplemental oxidizer component. Thus, in the broader practice of the invention, the gas generant materials may contain between about 0 and about 35 wt % of such an ammonium nitrate supplemental oxidizer component.

In accordance with the invention, it has been found that gas generant materials containing a substantial amount of metal ammine nitrate relative to the amount of ammonium nitrate desirably provides or results in increased burning rates and a decreased burning rate pressure exponent. While it is appreciated that in practice the inclusion of such metal ammine nitrate complexes in ammonium nitrate-containing compositions can serve to stabilize the phase changes normally associated with ammonium nitrate, these gas generant compositions typically include such metal ammine nitrate complexes in relative amounts or levels substantially greater or higher than those required for stabilization. As described in greater detail below, the inclusion of such metal ammine nitrate complexes in such relative amounts is believed to help result in the desired increase in burning rates and decrease in the burning rate pressure exponent. For example, in order to stabilize the phase changes of ammonium nitrate, a metal ammine nitrate content of no more than about 15 wt % is generally required or desired. In contrast, in these gas generant compositions, the metal ammine nitrate complexes are used at much greater or higher relative amounts or levels than required for stabilization and in most cases the amount or level of the metal ammine nitrate complexes can exceed the level or amount of ammonium nitrate in the compositions. Thus, such metal ammine nitrate complexes are sometimes referred to as the dominant or primary oxidizer of these gas generant compositions.

The gas generant materials may additionally desirably contain between about 2 and about 10 wt % of such metal oxide burn rate enhancing and slag formation additive. Examples of particular metal oxide burn rate enhancing and slag formation additives useful in the practice of the invention include silicon dioxide, aluminum oxide, titanium dioxide, boron oxide and combinations thereof. In general, silicon dioxide, aluminum oxide and combinations thereof are preferred metal oxide additives for use in the practice of the invention. The use of the metal oxide is as a burn rate enhancer and for the purpose of producing slag which is easily filtered from the gas stream of an airbag inflator. The incorporation and use of such silicon and aluminum oxide materials are particularly effective in facilitating the production of a slag material which is relatively easily filtered from the gas stream of an airbag inflator.

In the practice of the invention, it is believed that the combination of such metal oxide component and the relatively high levels of metal ammine nitrate present in the composition taken together are responsible for the high burning rate and the low burning rate pressure exponent of the compositions.

One particularly preferred gas generant composition in accordance with the invention includes:

- between about 35 and about 50 wt % of guanidine nitrate fuel,
- between about 30 and about 55 wt % copper diammine dinitrate oxidizer,
- between about 2 and about 10 wt % silicon dioxide burn rate enhancing and slag formation additive, and
- between about 0 and about 25 wt % ammonium nitrate supplemental oxidizer.

In accordance with another embodiment of the invention, a particularly useful gas generant composition for use in the practice of the invention includes: guanidine nitrate such as as a fuel component, basic copper nitrate, e.g., $Cu_2(OH)_3NO_3$, such as as an oxidizer component and a metal oxide such as aluminum oxide or silicon dioxide as a slag additive. An example of one particular gas generant composition in accordance with such a formulation contains: 55.64 wt % guanidine nitrate, 41.86 wt % basic copper nitrate, and 2.50 wt % aluminum oxide.

The gas generant materials used in the practice of the invention can take various selected forms such as grain, wafer or tablet, as may be desired.

As described above, solvents for use in the practice of the invention are desirably selected to be effective to partially solubilize at least one component of the ignition composition and, upon application to the gas generant material, to partially solubilize at least one component of the gas generant material. Particularly desirable solvents for use in the practice of the invention are those solvents having low vapor pressures such as may facilitate the subsequent removal thereof without requiring or necessitating application of lengthy or expensive drying operations. In view of the above, useful solvents for use in the practice of the invention typically may include water in combination with one or more various hydrocarbon-containing solvent materials such as one or more alcohols such as methanol, ethanol and isopropanol; one or more acetates such as ethyl, propyl, butyl and pentyl acetate; as well as combinations of such alcohols and acetates.

The selection of a particular solvent or solvent combination for use in association with a particular ignition composition may typically involve a consideration of various factors. In general, such selection typically involves a balancing of the ability of the ignition material combination formed by the combining of the ignition composition with a solvent to adhere to the selected gas generant and the ignition properties or characteristics of the product formed by the application of the ignition material combination onto the gas generant. In view thereof, it is generally desirable that a solvent or solvent combination selected for use with a particular ignition composition be effective to preferably dissolve at least about 2, more preferably, at least about 5 wt % and no more than about 40, more preferably no more than about 20 wt % of the ignition composition. For example, for certain preferred ignition compositions such as described herein and which ignition compositions contain strontium nitrate or potassium nitrate such as as oxidizers, a solvent combination containing between about 15 to about 25 vol % water and between about 75 to about 85 vol % ethanol has been found to generally result in a desirable balance of such adherence and ignitability factors.

As described above, an ignition material combination in accordance with the invention can be formed by combining the ignition composition with the solvent. While the so-formed combination can be variously described, such combinations will sometimes hereinafter be referred to as having the ignition composition suspended in a solvent or, more particularly, forming a solvent suspension.

The ignition material combination is subsequently applied onto the gas generant material whereby at least one component of the gas generant material is partially solubilized by the solvent of the ignition material combination. In the broader practice of the invention, such application can be done via various coating techniques including dipping and tumbling, for example. As described in greater detail below, a particularly preferred application technique for use in the practice of the invention involves spraying the ignition material combination onto the gas generant material.

Spray application provides various advantage or benefits which may not otherwise be easily or readily attainable via other application techniques. For example, spray application is generally very amenable to high rate production processes. In particular, in accordance with at least certain preferred embodiments of the invention, ignition composition fuels and oxidizers are dispersed in liquids which are a mixture of volatile fluids such that a resulting ignition material combination can be applied onto a gas generant, with the solvent subsequently easily removed, such as by means of an air stream, without requiring special drying equipment.

Further, spray application, such as by means of the directional nature of spray nozzles which may be employed, allows such an ignition material combination to be applied to selected areas of a consolidated pyrotechnic grain, such as in the bore of a perforated wafer stack, or selectively on the flat surfaces of a tablet. This is to be contrasted with dip coating, wherein generally everything that is submerged is coated. For example, dip coating processing is generally not amenable to the selective application or coating of the inner circumference of a perforated wafer.

Still further, spray application generally more readily permits the controlled homogeneous application of an ignition composition onto a pyrotechnic surface and such as may result in a more consistent coating surface texture and thickness. In dip coating, the thickness of the resulting coating generally depends on the rheology of the slurry mixture being applied because the amount of material deposited depends on the runoff of the excess slurry. Since runoff controls the amount deposited and the rate of runoff is controlled by the rheology of the slurry, then variability occurs as the rheology of the slurried coating material changes due to factors such as solvent evaporation, contamination with gas generant, and adsorption of moisture from the air. In contrast, in spray application the spray contacts the gas generant so the bulk supply of spray material is not itself necessarily contaminated with water and/or gas generant ingredients. In practice, the solvent system for a spray application process desirably does not change composition because it is contained within a closed system and the ignition material combination supply is itself not exposed to external air or the gas generant. Also, pooling and runoff are generally not a problem with spray application since only the amount of material required is contacted with the associated gas generant material.

In addition, the physical form of the applied material is generally amenable to facilitated control in a high rate manufacturing process when using a spray application technique. More specifically, the physical form of the applied material is generally controlled by the solvent composition, the solubility of fuels and oxidizers in the solvent system, and the drying time of the applied slurry. This is generally the case as the material which generally binds the ignition composition to the gas generant results from the recrystallization, precipitation or otherwise return to solid form of the soluble components as the solvent is removed.

Also, the deposition and drying during spray application processes as described herein are generally relatively fast and reproducible operations which, if desired, may occur substantially simultaneously.

In general, ignition enhanced gas generants in accordance with the invention are preferably composed of between about 0.5 to about 15 wt % igniter composition and between about 85 to about 99.5 wt % gas generant material.

Figure 2:
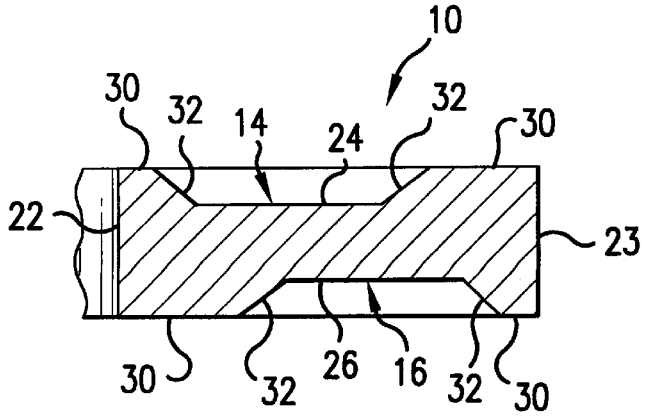
FIG. 2 is a cross sectional view of the gas generant wafer shown in FIG. 1, taken substantially along the lines 2—2 of FIG. 1.
Figure 3:
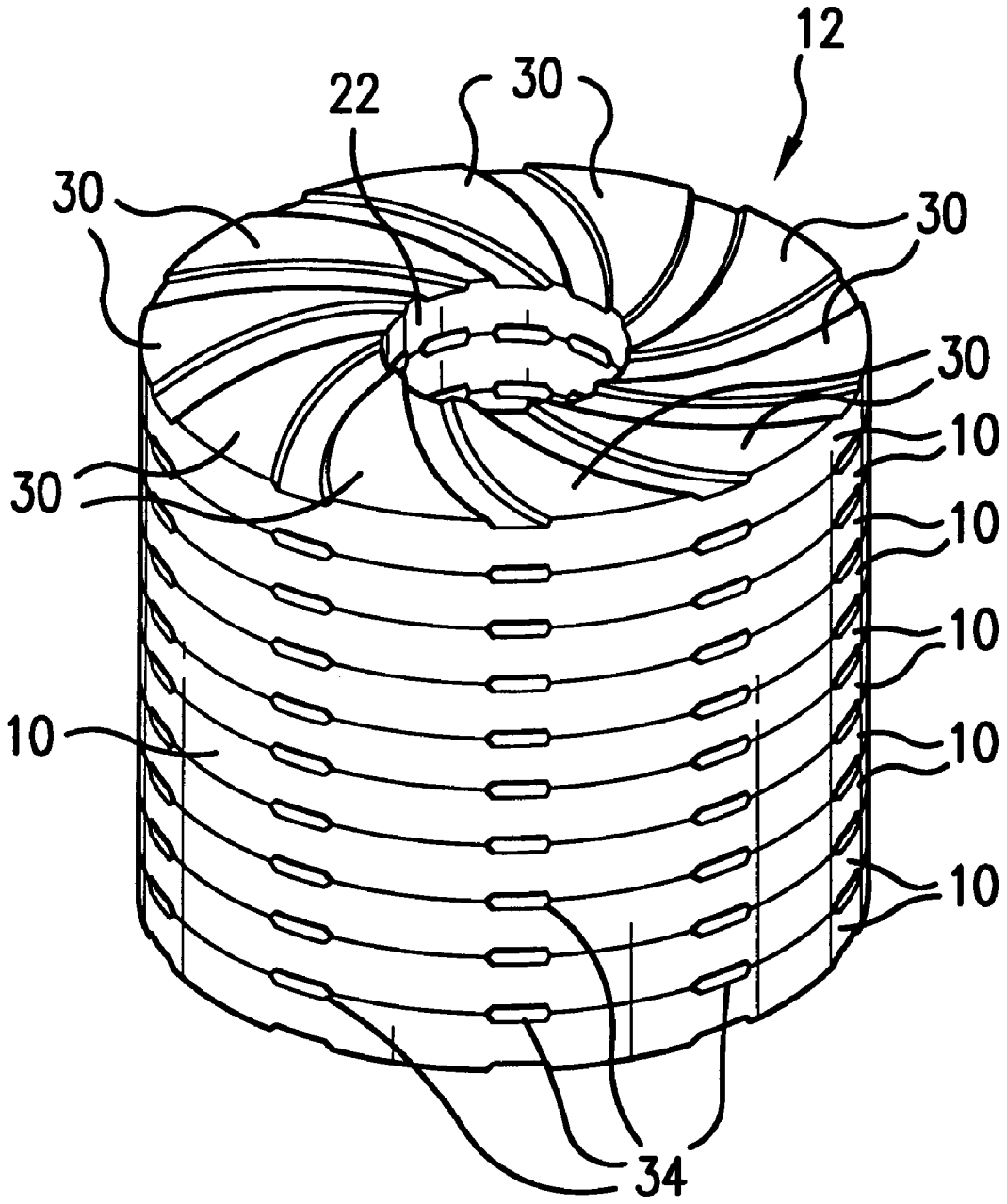
FIG. 3 is a perspective view of a stacked array of gas generant wafers, such as shown in FIGS. 1 and 2.

FIGS. 1 and 2 illustrate a particular configuration of a gas generant wafer, generally designated by the reference numeral 10, that can desirably be utilized in the practice of the invention. FIG. 3 illustrates a stacked array 12 of such gas generant wafers 10. Such specially shaped generant wafers and stacked arrays are specifically disclosed and described in commonly assigned Hock et al., U.S. Pat. No. 5,551,343, issued Sep. 3, 1996, the disclosure of which is fully incorporated herein by reference.

The gas generant wafer 10 is generally washer-shaped, sometimes referred to as a "perforated wafer." The gas generant wafer 10 has opposed first and second face surfaces, 14 and 16, respectively, and includes a central circular opening 20 with an interior edge or wall 22 and an outer perimeter edge or wall 23.

Each of the wafer face surfaces 14 and 16 includes a main surface, 24 and 26, respectively, and has ten projections or raised islands 30, each having the general shape of a curved-wall, irregular polygon. The projections 30 are generally alike (i.e., have the same cross section) and are uniformly circumferentially spaced about a respective wafer face surface 14 and 16. Each of the projections 30 has associated with it curved connecting walls 32 extending between the interior edge or wall 22 and the outer perimeter edge or wall 23.

As shown in FIG. 3, the projections 30 can serve to form spaces or gaps 34 between and penetrating the interfaces of adjacent wafers in the stacked gas generant wafer array 12. Such spaces can thus serve as gas flow passages facilitating combustion of the gas generant, especially in an inflator device.

In accordance with a particular aspect of the invention wherein the gas generant form includes an inner surface such as the interior edge or wall 22 in the above-described gas generant wafer 10, an ignition material combination in accordance with the invention can be selectively applied onto such an inner surface such as via spray application such as through the use of a spray application wand or other similar spray application device.

Further, through the use of such spray application processing the invention permits an ignition composition to be applied onto a gas generant material after the gas generant material has been inserted into an associated inflator subassembly, such as an unsealed can. The resulting ignition enhanced material can then be dried within the can, such as by means of an air stream, and further processing can proceed.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Examples 1–3

TABLE 1, below, provides the compositional make-up of three specific gas generant formulations onto which may be placed an ignition coating in accordance with the invention.

TABLE 1

| | Example | | |
|---|---|---|---|
| Ingredient | 1 | 2 | 3 |
| Guanidine nitrate | 47.21 | 45.60 | 55.64 |
| Ammonium nitrate | 40.62 | 11.57 | — |
| Copper diammine dinitrate | 7.17 | 37.73 | — |
| Silicon oxide | 5.00 | 5.10 | — |
| $Cu_2(OH)_3NO_3$ | — | — | 41.86 |
| Aluminum oxide | — | — | 2.50 |

Examples 4–6

TABLE 2, below, provides the compositional make-up of three specific ignition compositions which have successfully been applied to the gas generant formulations of Examples 1–3 in a 55 wt % suspension of 85 vol % ethanol and 15 vol % water, in accordance with the invention.

TABLE 2

| | Example | | |
|---|---|---|---|
| Ingredient | 4 | 5 | 6 |
| 70/30 Al/Mg alloy | 32.41 | 31.42 | — |
| Boron | — | — | 25.00 |
| Potassium nitrate | 67.59 | — | 75.00 |
| Strontium nitrate | — | 68.58 | — |

Examples 7–9

In these examples, 100 grams of the ignition composition of Example 5 was added to a solvent composed of 85 ml of ethanol and 15 ml of water resulting in the formation of an ignition material combination, in accordance with the invention. This ignition material combination was then applied onto forms of the gas generant formulation of Example 2 to form an ignition enhanced gas generant having a visually uniform coating of ignition composition thereon in three different levels or relative amounts (Ex 7=0.6 wt %, Ex 8=1.4 wt % and Ex 9=2.3 wt %, respectively).

For each of Examples 7–9, the respective ignition enhanced gas generant was loaded and fired using a heavyweight, reusable test fixture to simulate an airbag inflator assembly. A pressure transducer was mounted in the side of the fixture to permit dynamic (real-time) pressure measurements within the combustion chamber of the test fixture.

Figure 4:
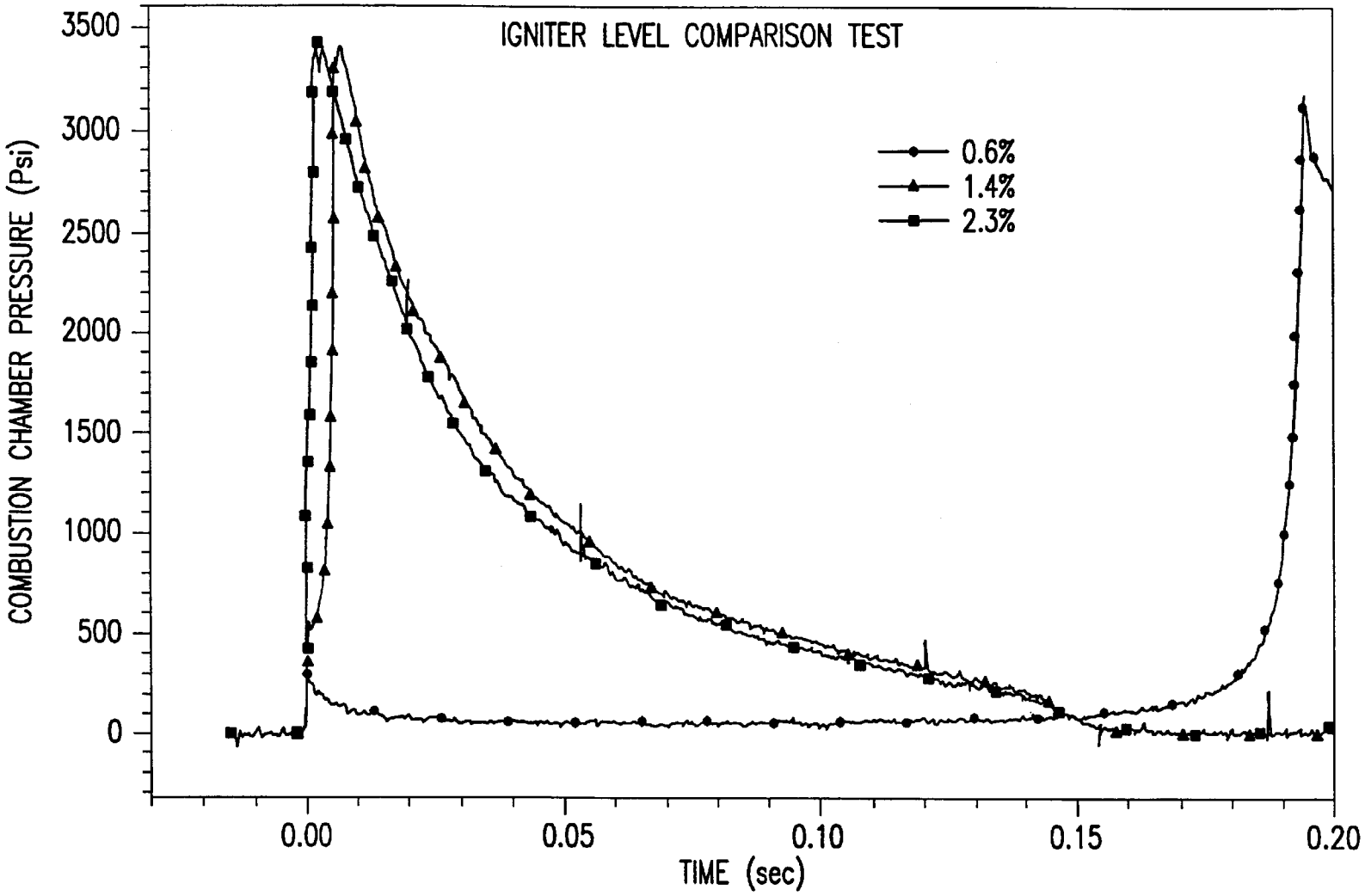
FIG. 4 shows the combustion chamber pressure as a function of time performances realized for the ignition enhanced gas generants of Examples 7–9.

FIG. 4 shows the combustion chamber pressure as a function of time performances realized for the ignition enhanced gas generants of Examples 7–9.

Discussion of Results

As shown by FIG. 4, in Example 7 there was a significant delay between actuation and an increase in combustion chamber pressure. In Examples 8 and 9, however, there was a significant reduction in such delay. These examples indicate that the amount of ignition composition applied onto an associated gas generant can be controlled to provide desired ignition and gas generation performance and that an ignition enhanced gas generant prepared in accordance with the invention can be utilized in an inflator device to result in desirable ignition.

Examples 10–14

TABLE 3, below, provides identification of specific solvent systems used for the spray application of the ignition composition of Example 5 onto forms of the gas generant formulation of Example 2 to form an ignition enhanced gas generant having a visually uniform coating of ignition composition thereon, in accordance with the above-described invention. In each case, 100 grams of the ignition composition was combined with 100 ml of the respective solvent combination of water and ethanol to form respective ignition material combinations which were then respectively applied onto forms of the gas generant formulation of Example 2 to form corresponding ignition enhanced gas generant materials having a visually uniform coating of ignition composition thereon in a level or relative amount of about 5.4 wt %.

The respective ignition enhanced gas generant materials were then subjected to aggressive vibration testing to evaluate the adherence of the ignition composition onto the gas generant forms. Specifically, 10 grams of one of each of the respective ignition enhanced gas generant materials was placed on a 25 mesh screen on a high speed shaker and subjected to high speed vibration for 5 minutes. In each case after being subjected to the high speed vibration, the ignition enhanced gas generant materials were removed from the screen and weighed to permit determination of loss of weight (taken to correspond to the loss of ignition composition)

TABLE 3, below, also provides identification of the percent of the ignition composition loss after vibration as well as comments regarding the visual appearance of the respective ignition enhanced gas generant materials after the vibration testing.

TABLE 3

| | | Post-Vibration | |
|---|---|---|---|
| Example | Solvent system % $H_2O$/% EtOH | % Igniter Loss | Visual Appearance |
| 10 | 5/95 | 83.14 | bare spots |
| 11 | 10/90 | 82.69 | bare spots |
| 12 | 15/85 | 51.41 | intact coating |
| 13 | 20/80 | 31.37 | intact coating |
| 14 | 25/75 | 25.79 | intact coating |

Discussion of Results

While the subject vibration testing was significantly more aggressive than commercially anticipated, as shown in TABLE 3, a solvent system content of at least about 15 vol % water resulted in an ignition enhanced gas generant wherein the ignition coating visually appeared to remain intact even after being subjected to such high speed vibration testing.

Examples 15–17

In each of these Examples, the ignition composition of Example 5 was applied onto tablet forms of the gas generant formulation of Example 2 via a combination of 100 grams of the ignition composition with 100 ml of a water/ethanol solvent system containing 0, 15 and 20 volume percent water, respectively, to form ignition enhanced gas generant having a visually uniform coating of ignition composition thereon, in accordance with the above-described invention.

Each of the respective ignition enhanced gas generant materials was then loaded into a heavyweight, reusable test fixture to simulate an airbag inflator assembly. The test fixture was fired into a closed tank equipped with a pressure transducer to permit dynamic (real-time) pressure measurements within the closed tank. A pressure transducer was also mounted in the side of the fixture to permit dynamic (real-time) pressure measurements within the combustion chamber of the test fixture.

Discussion of Results

Figure 5:
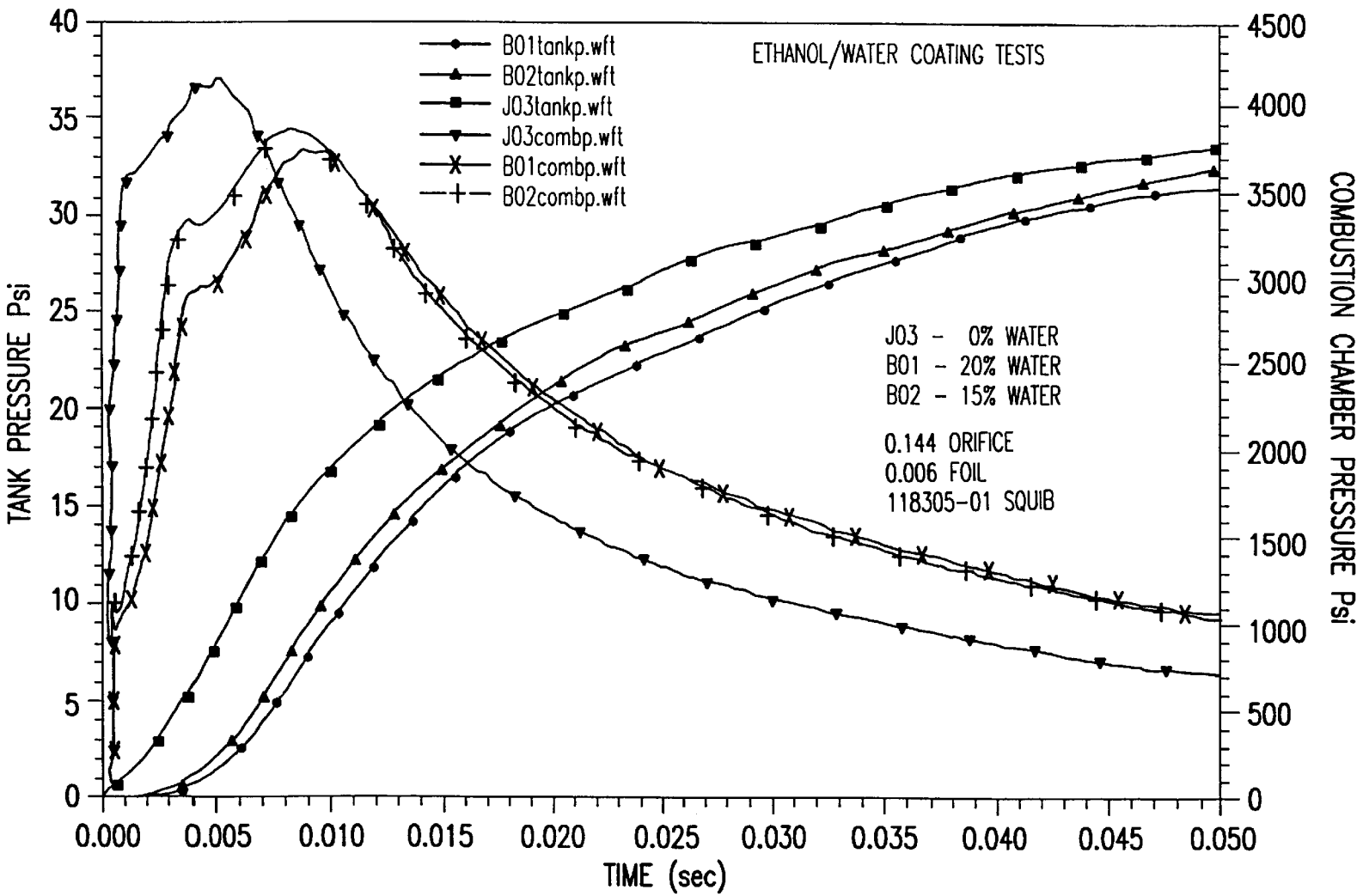
FIG. 5 shows the combustion chamber and the tank pressures as a function of time performances realized for the ignition enhanced gas generants of Examples 15–17.

FIG. 5 shows the combustion chamber and the tank pressures as a function of time performances realized for the ignition enhanced gas generants of Examples 15–17.

Review of the combustion chamber and the tank pressures as a function of time performances realized for the ignition enhanced gas generants of Examples 15–17 shows that ignitability decreased, i.e., ignition delay increased, with increasing water content in the solvent system.

Taken in conjunction with the results of above Examples 10–14, this shows the desirability of balancing ignition composition adherence to the gas generant with performance of the ignition enhanced gas generant to determine the optimal or preferred relative amount of water to be included in the solvent system used in association with an ignition composition, in accordance with the invention.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method of placing an ignition composition onto a gas generant material having a selected form, said method comprising the steps of:

combining the ignition composition with a solvent to form an ignition material combination, the solvent effective to partially solubilize at least one component of the ignition composition and, upon application to the gas generant material, to partially solubilize at least one component of the gas generant material and applying the ignition material combination onto the gas generant material form whereby at least one component of the gas generant material is partially solubilized by the solvent of the ignition material combination, wherein the gas generant material includes a fuel component and an oxidizer component, with the fuel component including at least one fuel selected from the group consisting of nitrogen-containing organic fuels and a tetrazole complex of a transition metal selected from the group consisting of copper, cobalt and zinc and the oxidizer component including at least one oxidizer material selected from the group consisting of at least one metal ammine nitrate, basic copper nitrate and ammonium nitrate.

2. The method of claim 1 wherein said applying step comprises spraying the ignition material combination onto the gas generant material form.

3. The method of claim 1 wherein the ignition composition includes an oxidizer component and wherein the oxidizer component is the at least one component of the ignition composition partially solubilized by the solvent.

4. The method of claim 3 wherein the ignition composition includes at least one oxidizer selected from the group consisting of alkali metal nitrates, chlorates and perchlorates; alkaline earth metal nitrates, chlorates and perchlorates; ammonium nitrate; ammonium perchlorate; basic copper nitrate and combinations thereof.

5. The method of claim 1 wherein the gas generant material includes an oxidizer component and wherein the oxidizer component is the at least one component of the gas generant material partially solubilized by the solvent.

6. A method of placing an ignition composition onto a gas generant material having a selected form, said method comprising the steps of:

combining the ignition composition with a solvent to form an ignition material combination, the solvent effective to partially solubilize at least one component of the ignition composition and, upon application to the gas generant material, to partially solubilize at least one component of the gas generant material and applying the ignition material combination onto the gas generant material from whereby at least one component of the gas generant material is partially solubilized by the solvent of the ignition material combination, wherein the gas generant material includes an oxidizer component comprising ammonium nitrate and wherein the oxidizer component is the at least one component of the gas generant material partially solubilized by the solvent.

7. The method of claim 1 wherein the gas generant material includes a fuel component and wherein the fuel component is the at least one component of the gas generant material partially solubilized by the solvent.

8. A method of placing an ignition composition onto a gas generant material having a selected form, said method comprising the steps of:

combining the ignition composition with a solvent to form an ignition material combination, the solvent effective to partially solubilize at least one component of the ignition composition and, upon application to the gas generant material, to partially solubilize at least one component of the gas generant material and applying the ignition material combination onto the gas generant material from whereby at least one component of the gas generant material is partially solubilized by the solvent of the ignition material combination, wherein the gas generant material includes a fuel component comprising guanidine nitrate.

9. The method of claim 8 wherein the gas generant material comprises:

between about 35 and about 50 wt % of guanidine nitrate fuel, between about 30 and about 55 wt % copper diammine dinitrate oxidizer, between about 2 and about 10 wt % of a burn rate enhancing and slag formation additive, and between about 0 and about 25 wt % ammonium nitrate supplemental oxidizer.

10. The method of claim 8 wherein the gas generant material additionally comprises:

basic copper nitrate as an oxidizer component and a metal oxide slag formation additive.

11. The method of claim 1 wherein the gas generant material form includes an inner surface and wherein said spray application step selectively applies the ignition material combination onto at least a portion of the inner surface.

12. The method of claim 1 wherein the gas generant material form is one selected from the group consisting of grain, wafer and tablet.

13. A method of placing an ignition composition onto a gas generant material having a selected form, said method comprising the steps of:

combining the ignition composition with a solvent to form an ignition material combination, the solvent effective to partially solubilize at least one component of the ignition composition and, upon application to the gas generant material, to partially solubilize at least one component of the gas generant material and applying the ignition material combination onto the gas generant material from whereby at least one component of the gas generant material is partially solubilized by the solvent of the ignition material combination, wherein the solvent includes a combination of water and at least one hydrocarbon-containing solvent material.

14. The method of claim 13 wherein the hydrocarbon-containing solvent material is selected from the group consisting of: methanol, ethanol, isopropyl alcohol and combinations thereof.

15. The method of claim 13 wherein the hydrocarbon-containing solvent comprises a combination of ethanol and water.

16. A method of applying an ignition composition to gas generant material comprising ammonium nitrate, wherein the gas generant material has a form selected from the group consisting of a grain, tablet and wafer, said method comprising the steps of:

suspending the ignition composition in a hydrocarbon-containing solvent effective to partially solubilize at least one component of the ignition composition and spraying the solvent-suspended ignition composition onto the gas generant material form, the solvent effective to partially solubilize the ammonium nitrate of the gas generant material.

17. The method of claim 16 wherein the gas generant material form includes an inner surface and wherein said spraying step selectively applies the solvent-suspended ignition composition onto at least a portion of the gas generant material form inner surface.

18. A body of material which is ignitable to generate a gas for inflating an airbag, said body of material comprising:

a gas generant material having a selectively applied spray coating of an ignition composition, wherein the gas generant material includes a fuel component and an oxidizer component, with the fuel component including at least one fuel selected from the group consisting of nitrogen-containing organic fuels and a tetrazole complex of a transition metal selected from the group consisting of copper, cobalt and zinc and the oxidizer component including at least one oxidizer material selected from the group consisting of at least one metal ammine nitrate, basic copper nitrate and ammonium nitrate.

19. The ignitable body of material of claim 18 wherein the ignition composition is applied in the form of a combination of the ignition composition and a solvent effective to partially solubilize at least one component of the ignition composition and, upon application to the gas generant material, to partially solubilize at least one component of the gas generant material.

20. The ignitable body of material of claim 18 wherein the ignition composition includes an oxidizer component and wherein the ignition composition oxidizer component is the at least one component of the ignition composition partially solubilized by the solvent.

21. The ignitable body of material of claim 20 wherein the ignition composition comprises at least one oxidizer selected from the group consisting of alkali metal nitrates, chlorates and perchlorates; alkaline earth metal nitrates, chlorates and perchlorates; ammonium nitrate; ammonium perchlorate; basic copper nitrate and combinations thereof.

22. The ignitable body of material of claim 18 wherein the gas generant material includes an oxidizer component and wherein the oxidizer component is the at least one component of the gas generant material partially solubilized by the solvent.

23. A body of material which is ignitable to generate a gas for inflating an airbag, said body of material comprising:

a gas generant material having a selectively applied spray coating of an ignition composition, wherein the ignition composition is applied in the form of a combination of the ignition composition and a solvent effective to partially solubilize at least one component of the ignition composition and, upon application to the gas generant material, to partially solubilize at least one component of the gas generant material, wherein the gas generant material includes an oxidizer component comprising ammonium nitrate and wherein the gas generant material oxidizer component is the at least one component of the gas generant material partially solubilized by the solvent.

24. The ignitable body of material of claim 18 wherein the gas generant material includes a fuel component and wherein the fuel component is the at least one component of the gas generant material partially solubilized by the solvent.

25. A body of material which is ignitable to generate a gas for inflating an airbag, said body of material comprising:

a gas generant material having a selectively applied spray coating of an ignition composition, wherein the ignition composition is applied in the form of a combination of the ignition composition and a solvent effective to partially solubilize at least one component of the ignition composition and, upon application to the gas generant material, to partially solubilize at least one component of the gas generant material, wherein the gas generant material includes a fuel component comprising guanidine nitrate and wherein the gas generant material fuel component is the at least one component of the gas generant material partially solubilized by the solvent.

26. The ignitable body of material of claim 25 wherein the gas generant material comprises:

between about 35 and about 50 wt % of guanidine nitrate fuel, between about 30 and about 55 wt % copper diammine dinitrate oxidizer, between about 2 and about 10 wt % of a burn rate enhancing and slag formation additive, and between about 0 and about 25 wt % ammonium nitrate supplemental oxidizer.

27. The ignitable body of material of claim 25 wherein the gas generant material additionally comprises:

basic copper nitrate as an oxidizer component and a metal oxide slag formation additive.

28. The ignitable body of material of claim 18 wherein the gas generant material is a form which includes an inner surface onto which the ignition composition has been selectively applied.

29. The method of claim 1 wherein the fuel component includes at least one nitrogen-containing organic fuel selected from the group consisting of guanidine nitrate, aminoguanidine nitrate, triaminoguanidine nitrate, nitroguanidine, dicyandiamide, triazalone, nitrotriazalone, tetrazoles and mixtures thereof.

30. The ignitable body of material of claim 18 wherein the fuel component includes at least one nitrogen-containing organic fuel selected from the group consisting of guanidine nitrate, aminoguanidine nitrate, triaminoguanidine nitrate, nitroguanidine, dicyandiamide, triazalone, nitrotriazalone, tetrazoles and mixtures thereof.

* * * * *